US012330043B2

(12) United States Patent
Chiyoda

(10) Patent No.: US 12,330,043 B2
(45) Date of Patent: Jun. 17, 2025

(54) COMBINATION SLIDING MITTEN

(71) Applicant: Roof and Solar Technologies, Inc., Poway, CA (US)

(72) Inventor: Takashi Chiyoda, Poway, CA (US)

(73) Assignee: Roof and Solar Technologies, Inc., Poway, CA (US)

( * ) Notice: Subject to any disclaimer, the term of this patent is extended or adjusted under 35 U.S.C. 154(b) by 15 days.

(21) Appl. No.: 18/378,867

(22) Filed: Oct. 11, 2023

(65) Prior Publication Data

US 2024/0269537 A1 Aug. 15, 2024

Related U.S. Application Data

(63) Continuation-in-part of application No. 18/108,830, filed on Feb. 13, 2023, now Pat. No. 12,090,386.

(51) Int. Cl.
*A63B 71/12* (2006.01)
*A63B 71/14* (2006.01)

(52) U.S. Cl.
CPC ..... *A63B 71/143* (2013.01); *A63B 71/1225* (2013.01); *A63B 2071/1258* (2013.01)

(58) Field of Classification Search
CPC ..... A63B 71/143; A63B 2102/18; A63B 2071/1258; A41D 13/081; A41D 19/00; A41D 13/0543
See application file for complete search history.

(56) References Cited

U.S. PATENT DOCUMENTS 4,068,312 A * 1/1978 Ledesma ..... A41D 13/065 2/24
4,700,404 A * 10/1987 Potvin ..... A63B 71/143 2/161.1
5,007,108 A * 4/1991 Laberge ..... A41D 13/0518 2/463
5,056,158 A 10/1991 Lutz
D346,245 S 4/1994 Krent et al.
5,655,221 A * 8/1997 Worischeck ..... A63B 71/12 2/16
5,672,127 A 9/1997 Danz
5,699,632 A 12/1997 Stout et al.
5,794,261 A 8/1998 Hefling
(Continued)

FOREIGN PATENT DOCUMENTS

CA 2656300 C 9/2012
CN 200957283 Y 10/2007
(Continued)

OTHER PUBLICATIONS https://g-form.com/elite-2-baseball-batters-elbow-guard.
(Continued)

*Primary Examiner* — Tajash D Patel
(74) *Attorney, Agent, or Firm* — Procopio, Cory, Hargreaves & Savitch LLP

(57) ABSTRACT

A combination sliding mitten and lower-leg protector comprising a sliding mitten sleeve; one or more lower-leg guards carried by the sliding mitten sleeve, wherein in a lower-leg protector configuration, a user's lower leg is received along the sliding mitten sleeve and protected by the one or more lower-leg guards, in a sliding mitten configuration, a user's hand is received within the sliding mitten sleeve and protected by the one or more lower-leg guards.

5 Claims, 4 Drawing Sheets

(56) References Cited

U.S. PATENT DOCUMENTS

| | | | | |
|---|---|---|---|---|
| 6,085,352 | A * | 7/2000 | Martin | A63B 71/143 2/16 |
| 6,996,847 | B2 | 2/2006 | Anderson | |
| 8,376,976 | B2 | 2/2013 | Scott et al. | |
| 8,479,313 | B2 | 7/2013 | Jones | |
| D775,430 | S | 12/2016 | Dupree et al. | |
| 9,555,312 | B2 | 1/2017 | Machado | |
| 9,855,486 | B2 | 1/2018 | Gerda et al. | |
| D838,415 | S | 1/2019 | Durpree et al. | |
| D887,647 | S | 6/2020 | Kim, Jr. | |
| D928,417 | S | 8/2021 | Anthony et al. | |
| 12,090,386 | B2 * | 9/2024 | Chiyoda | A63B 71/143 |
| 2004/0045079 | A1 | 3/2004 | Quintero | |
| 2007/0234460 | A1 | 10/2007 | Castonguay et al. | |
| 2014/0259258 | A1 | 9/2014 | Miranda | |
| 2016/0029712 | A1 | 2/2016 | Hull | |
| 2016/0249692 | A1 | 9/2016 | Guidetti | |

FOREIGN PATENT DOCUMENTS

| | | | |
|---|---|---|---|
| DE | 202013003259 | U1 | 6/2013 |
| KR | 102443263 | B1 | 9/2022 |
| WO | 99/38400 | A1 | 8/1999 |

OTHER PUBLICATIONS https://tru-pro.net/ sliding mitt.
https://www.benik.com/adults/athletics/baseball-sliding-mitt.
Official Action mailed Apr. 10, 2024 in U.S. Appl. No. 18/108,830 to Chiyoda, 11 pages.

* cited by examiner

COMBINATION SLIDING MITTEN

CROSS-REFERENCE TO RELATED APPLICATIONS

This application is a Continuation-in-Part Application of U.S. patent application Ser. No. 18/108,830, filed on Feb. 13, 2023, entitled COMBINATION SLIDING MITTEN AND ELBOW PROTECTOR, the entire contents of each application are incorporated herein by reference in their entirety.

FIELD OF THE INVENTION

The present invention relates to sliding mittens for baseball and softball.

BACKGROUND OF THE INVENTION

In baseball/softball, separate sliding mittens to protect one's hand when sliding head first into a base, batting elbow protectors to protect one's elbow and surrounding area when hit by a wild pitch, and shin protectors to protect one's lower leg when hit by a wild pitch or fouled ball are often used by players. A problem with the elbow protector and the shin protector are that, after batting, the elbow protector/shin protector is removed because it is no longer needed and has to be given to a bat boy or base coach. A problem with the sliding mitten is that it is not needed during batting, but is frequently carried in a player's back pocket during batting/running to first base or is provided to the player that reaches base by a base coach. Accordingly, utilizing these separate protection devices involves taking up the time resources of bat boy/base coach and/or have to be carried by the player when not needed.

SUMMARY OF THE INVENTION

Aspects of the disclosure involve a combination sliding mitten and elbow protector comprising a sliding mitten sleeve; one or more arm guards carried by the sliding mitten sleeve, wherein in an elbow protector configuration, a user's arm is received along the sliding mitten sleeve and protected by the one or more arm guards, in a sliding mitten configuration, a user's hand is received within the sliding mitten sleeve and protected by the one or more arm guards.

One or more implementations of the aspects of the disclosure described immediately above includes one or more of the following: the one or more arm guards include an upper arm guard with one or more upper arm guard straps and a lower arm member including one or more lower arm guard straps, the sliding mitten sleeve includes an open end and an opposite closed, wherein, in the elbow protector configuration, the user's upper arm is received along the sliding mitten sleeve, strapped to and protected by the upper arm guard by the one or more upper arm guard straps, and the user's lower arm is received along the sliding mitten sleeve, strapped to and protected by the lower arm guard by the one or more lower arm guard straps, in a sliding mitten configuration, a user's hand is received within the sliding mitten sleeve, strapped to and protected by the upper arm guard by the one or more upper arm guard straps, and the user's wrist is received within the sliding mitten sleeve, strapped to and protected by the lower arm guard; and/or a sliding wrist support, and, in the sliding mitten configuration, the user's wrist is supported by the sliding wrist support.

Further aspects of the disclosure involve a method of using a combination sliding mitten and elbow protector comprising, at bat, donning the combination sliding mitten and elbow protector in an elbow protector configuration so that a player's arm is received along a sliding mitten sleeve and protected by one or more arm guards, and, on base, donning the combination sliding mitten and elbow protector in a sliding mitten configuration so that player's hand is received within the sliding mitten sleeve and protected by the one or more arm guards.

One or more implementations of the aspects of the disclosure described immediately above includes one or more of the following, at bat, donning the combination sliding mitten and elbow protector in the elbow protector configuration so that the player's upper arm is received along the sliding mitten sleeve, strapped to and protected by an upper arm guard by one or more upper arm guard straps, and the player's lower arm is received along the sliding mitten sleeve, strapped to and protected by a lower arm guard by one or more lower arm guard straps, and, on base, donning the combination sliding mitten and elbow protector in the sliding mitten configuration so that player's hand is received within the sliding mitten sleeve, strapped to and protected by the upper arm guard by the one or more upper arm guard straps, and the player's wrist is received within the sliding mitten sleeve, strapped to and protected by the lower arm guard; and/or, in the sliding mitten configuration, the player's wrist is supported by a sliding wrist support.

Aspects of the disclosure involve a combination sliding mitten and lower-leg protector comprising a sliding mitten sleeve; one or more lower-leg guards carried by the sliding mitten sleeve, wherein in a lower-leg protector configuration, a user's lower leg is received along the sliding mitten sleeve and protected by the one or more lower-leg guards, in a sliding mitten configuration, a user's hand is received within the sliding mitten sleeve and protected by the one or more lower-leg guards.

One or more implementations of the aspects of the disclosure described immediately above includes one or more of the following: the one or more lower-leg guards include an upper guard with one or more upper guard straps and a lower guard including one or more lower guard straps, the sliding mitten sleeve includes an open end and an opposite closed, wherein, in the lower-leg protector configuration, the user's lower leg is received along the sliding mitten sleeve, strapped to and protected by the upper guard by the one or more upper guard straps, and the user's upper foot portion is received along the sliding mitten sleeve, strapped to and protected by the lower guard by the one or more lower guard straps, in a sliding mitten configuration, a user's hand is received within the sliding mitten sleeve, strapped to and protected by the lower guard by the one or more lower guard straps, and the user's wrist is received within the sliding mitten sleeve, strapped to and protected by the upper guard; and/or a sliding wrist support, and, in the sliding mitten configuration, the user's wrist is supported by the sliding wrist support.

Further aspects of the disclosure involve a method of using a combination sliding mitten and lower-leg protector comprising, at bat, donning the combination sliding mitten and lower-leg protector in a lower-leg protector configuration so that a player's lower leg is received along a sliding mitten sleeve and protected by one or more lower-leg guards, and, on base, donning the combination sliding mitten and lower-leg protector in a sliding mitten configuration so that player's hand is received within the sliding mitten sleeve and protected by the one or more lower-leg guards.

One or more implementations of the aspects of the disclosure described immediately above includes one or more of the following, at bat, donning the combination sliding mitten and lower-leg protector in the lower-leg protector configuration so that the player's lower leg is received along the sliding mitten sleeve, strapped to and protected by an upper guard by one or more upper guard straps, and the player's upper foot portion is received along the sliding mitten sleeve, strapped to and protected by a lower guard by one or more lower guard straps, and, on base, donning the combination sliding mitten and lower-leg protector in the sliding mitten configuration so that player's hand is received within the sliding mitten sleeve, strapped to and protected by the lower guard by the one or more lower guard straps, and the player's wrist is received within the sliding mitten sleeve, strapped to and protected by the upper guard; and/or, in the sliding mitten configuration, the player's wrist is supported by a sliding wrist support.

BRIEF DESCRIPTION OF DRAWINGS

The accompanying drawings, which are incorporated in and form a part of this specification illustrate embodiments of the invention and together with the description, serve to explain the principles of the invention.

DESCRIPTION OF EMBODIMENT OF THE INVENTION

Figure 1:
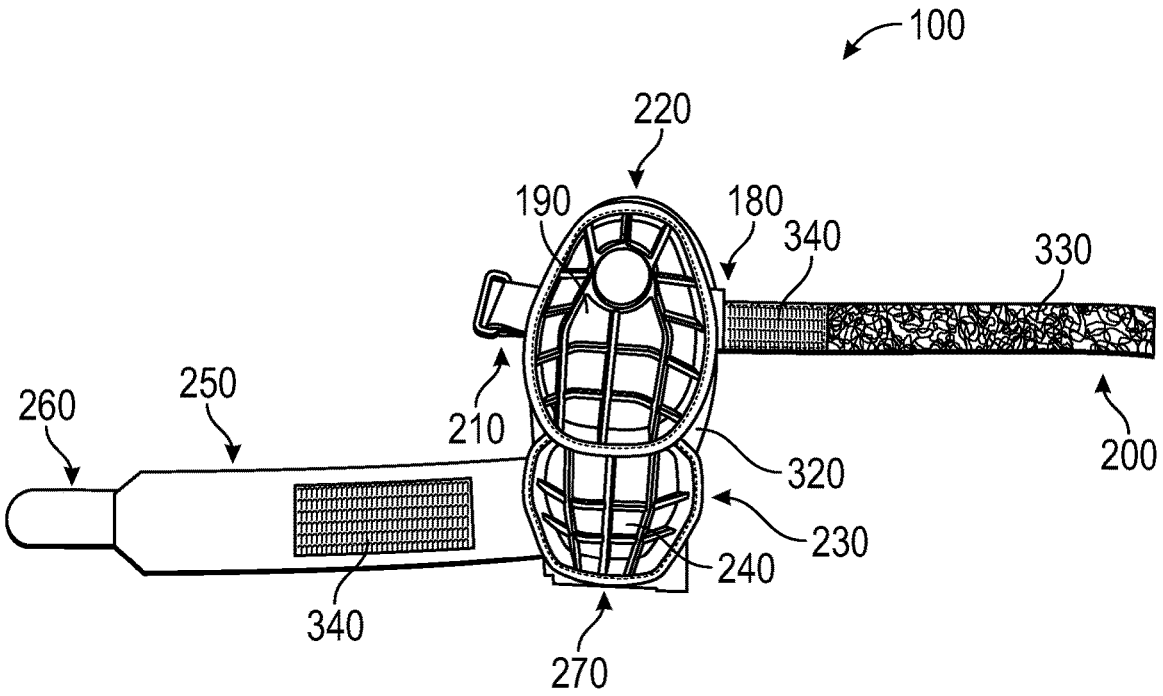
FIG. 1 is a top plan view of the combination sliding mitten and elbow protector.

With reference to FIGS. 1-5, an embodiment of a combination sliding mitten and elbow protector 100 and method of using the same will be described. The combination sliding mitten and elbow protector ("protector") 100 quickly and easily converts between sliding mitten configuration (FIGS. 3, 4) 110 applied to a user's hand 120 and wrist area 130, protecting the user's hand 120 and wrist area 130 when sliding into base, and an elbow protector configuration 140 applied to a user's elbow area 150, lower arm 160, and upper arm 170, protecting the user's arm 172, and especially the elbow area 150, when batting.

Figure 2:
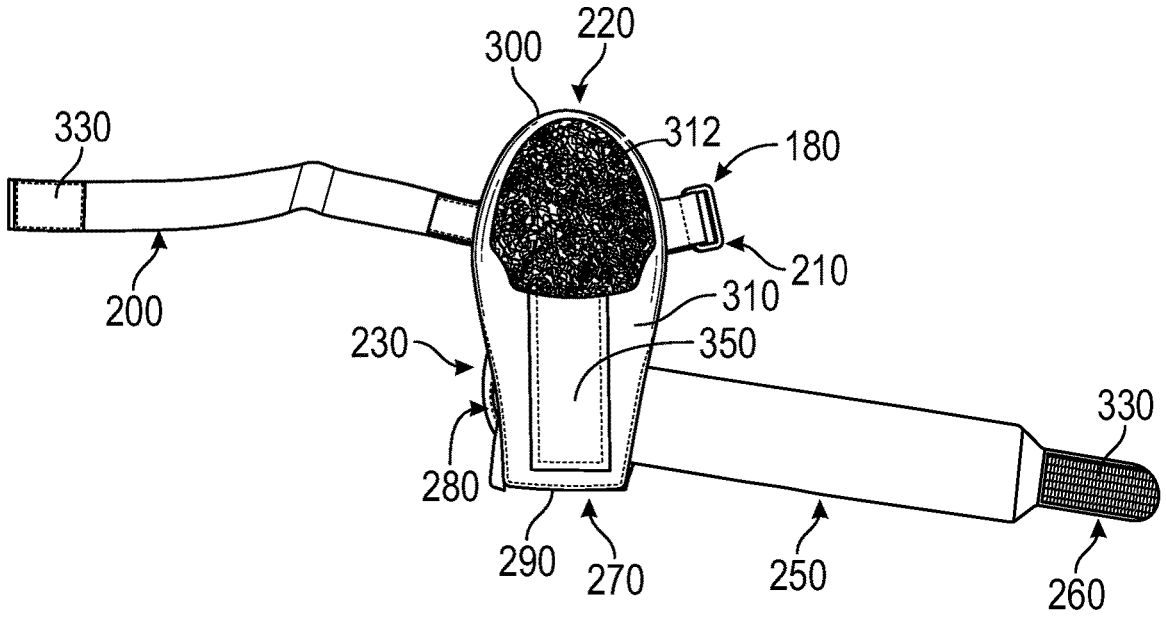
FIG. 2 is a bottom plan view of the combination sliding mitten and elbow protector.

As illustrated in FIGS. 1 and 2, the protector 100 includes an upper arm member 180 including an upper arm guard 190, one or more upper arm/first straps 200, 210, and a distal end 220, a lower arm member 230 including a lower arm guard 240, one or more lower arm/second straps 250, 260, and a distal end 270, and a sliding mitten sleeve 280 extending from the distal end 220 of the upper arm member 180 to the opposite distal end 270 of the lower arm member 230. The sliding mitten sleeve 280 includes an open end 290 at the distal end 270 of the lower arm member 230, a closed end 300 at the distal end 220 of the upper arm member 180, a front 310 with a sliding pad 312, and a rear 320. In alternative embodiments, the protector 100 includes one or more (e.g., 1, 3, etc.) arm guards.

The one or more upper arm/first straps 200, 210 and the one or more lower arm/second straps 250, 260 include hook and loop fastener sections 330, 340.

The sliding mitten sleeve 280 includes a sliding wrist support 350.

Figure 3:
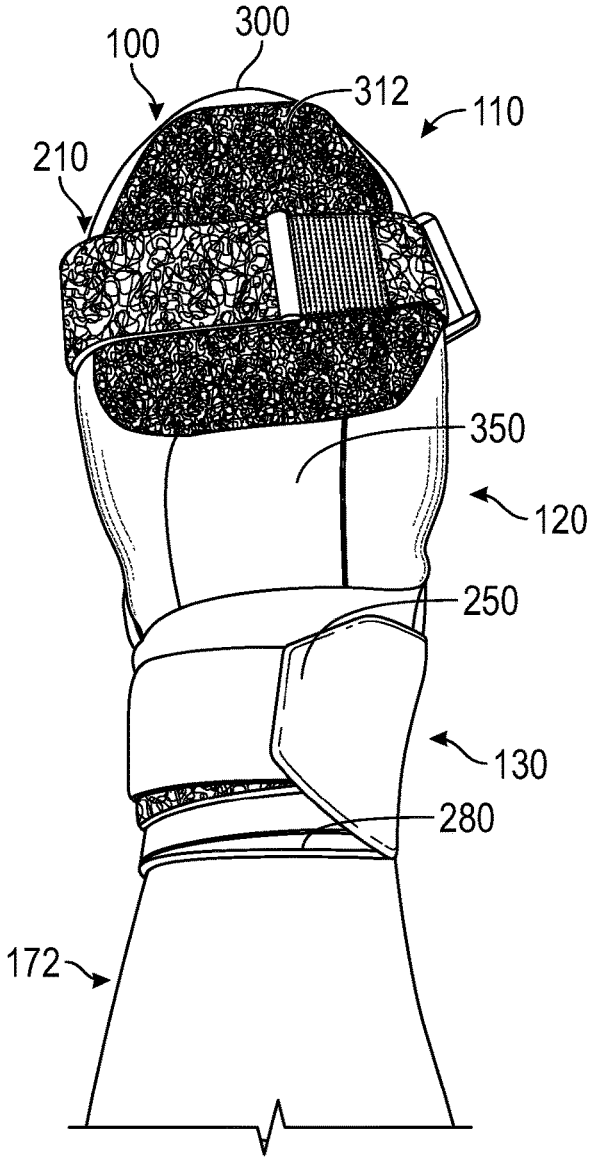
FIG. 3 is a bottom plan view of the combination sliding mitten and elbow protector shown in a sliding mitten configuration applied to a user's hand and wrist area.
Figure 4:
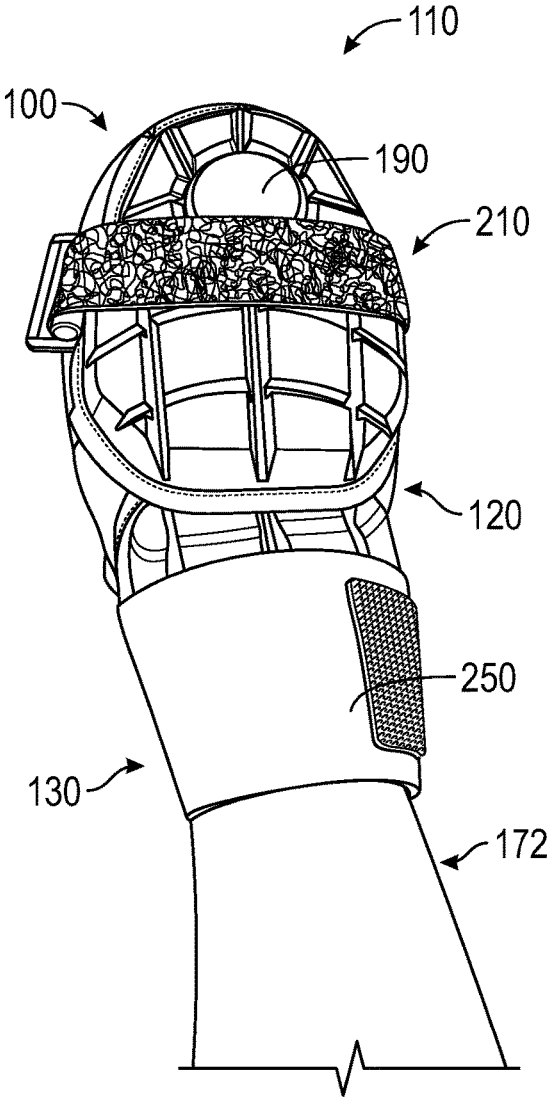
FIG. 4 is a top plan view of the combination sliding mitten and elbow protector shown in a sliding mitten configuration applied to a user's hand and wrist area, protecting the user's hand when sliding into base.

As illustrated in FIGS. 3 and 4, in the elbow protector configuration 140 (e.g., when a user is up to bat), the user's arm 172 is received along the sliding mitten sleeve 280 and protected by the one or more arm guards 190, 240. In this configuration 140, the player's upper arm 170 is received along the sliding mitten sleeve 280, strapped by the one or more upper arm guard straps 200, 210 to and protected by the upper arm guard 190, and the player's lower arm 160 is received along the sliding mitten sleeve 280, strapped by the one or more lower arm guard straps 250, 260 to and protected by the lower arm guard 240.

In the sliding mitten configuration 110 (e.g., when on base), a player's hand 120 is received within the sliding mitten sleeve 280 and protected by the one or more arm guards 190, 240. In this configuration 110, the player's hand 120 is received within the sliding mitten sleeve, strapped by the one or more upper arm guard straps 200, 210 to and protected by the upper arm guard 190, and the player's wrist area 130 is received within the sliding mitten sleeve 280, strapped by the one or more lower arm guard straps 250, 260 to and protected by the lower arm guard 240. In this configuration 110, the player's wrist area 130 is supported by the sliding wrist support 350 and the sliding pad 312 and upper arm guard 190 provide double-layer protection, which also reduces shock to the player's hand 120 when sliding into base.

Figure 5:
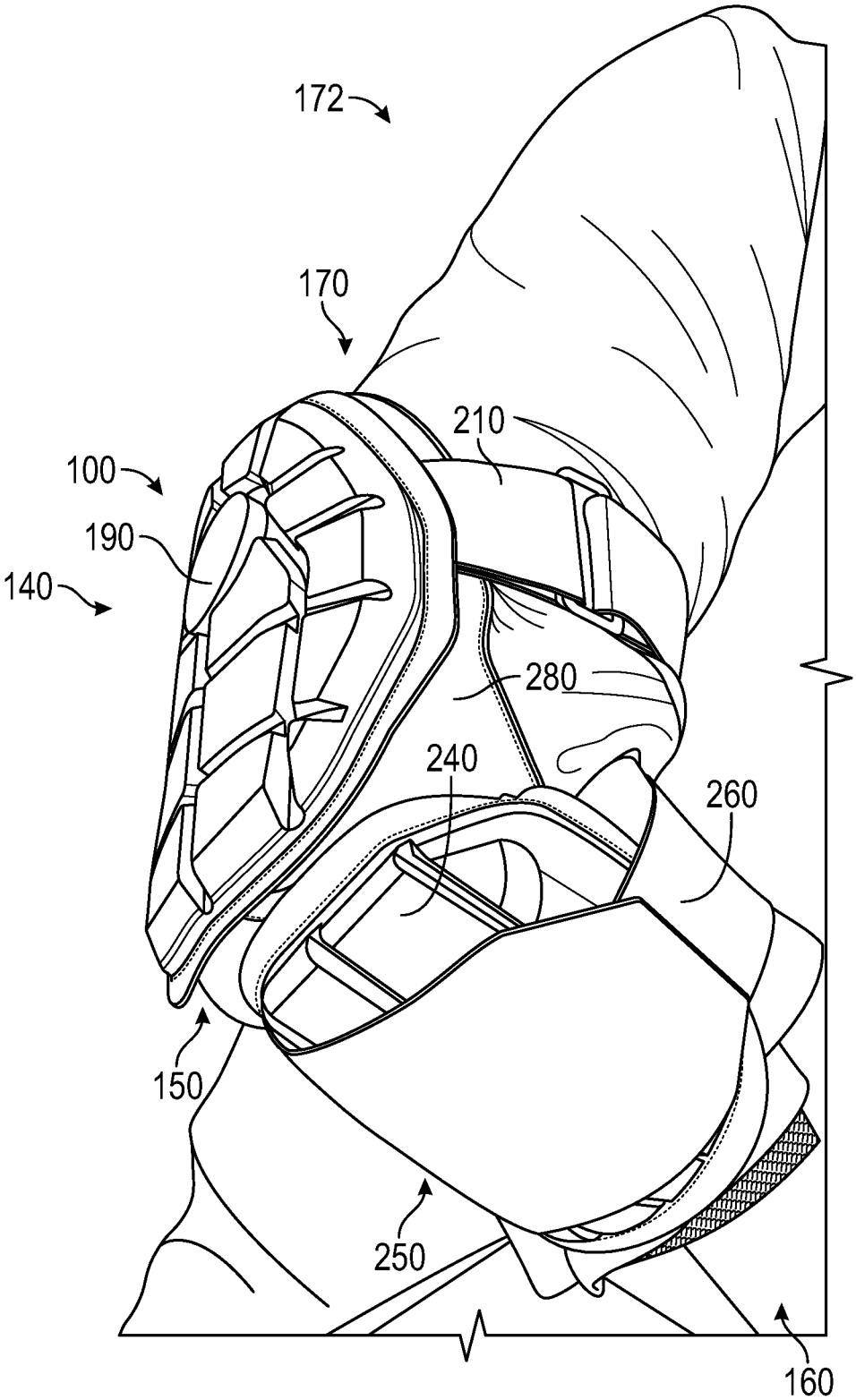
FIG. 5 is a perspective view of the combination sliding mitten and elbow protector shown in an elbow protector configuration applied to a user's elbow area, protecting the user's elbow when batting.

With reference to FIGS. 4 and 5, a method of using the combination sliding mitten and elbow protector 100 as baseball/software gear to protect the user's elbow area 150 when batting and to protect the user's hand 120 when sliding to the base comprises, at bat, donning the combination sliding mitten and elbow protector 100 in the elbow protector configuration 140 so that the player's arm 172 is received along the sliding mitten sleeve 280 and protected by the one or more arm guards 190, 240. Donning in the elbow protector configuration further comprises, donning the combination sliding mitten and elbow protector 100 in the elbow protector configuration so that the player's upper arm 170 is received along the sliding mitten sleeve 280, strapped to and protected by the upper arm guard 190 by the one or more upper arm guard straps 200, 210, and the player's lower arm 160 is received along the sliding mitten sleeve 280, strapped to and protected by the lower arm guard 240 by the one or more lower arm guard straps 250, 260. The method further comprises, on base, donning the combination sliding mitten and elbow protector 100 in the sliding mitten configuration 110 so that player's hand is received within the sliding mitten sleeve 280 and protected by the one or more arm guards 190, 240 during sliding. Donning in the sliding mitten configuration 110 further comprises, donning the combination sliding mitten and elbow protector 100 in the sliding mitten configuration 110 so that player's hand 120 is received within the sliding mitten sleeve 280, strapped to and protected by the upper arm guard 190 by the one or more upper arm guard straps 200, 210, and the player's wrist 130 is received within the sliding mitten sleeve 280, strapped to and protected by the lower arm guard 240. Donning in the sliding mitten configuration 110 still further comprises, supporting the player's wrist 130 by the sliding wrist support 350.

Figure 6:
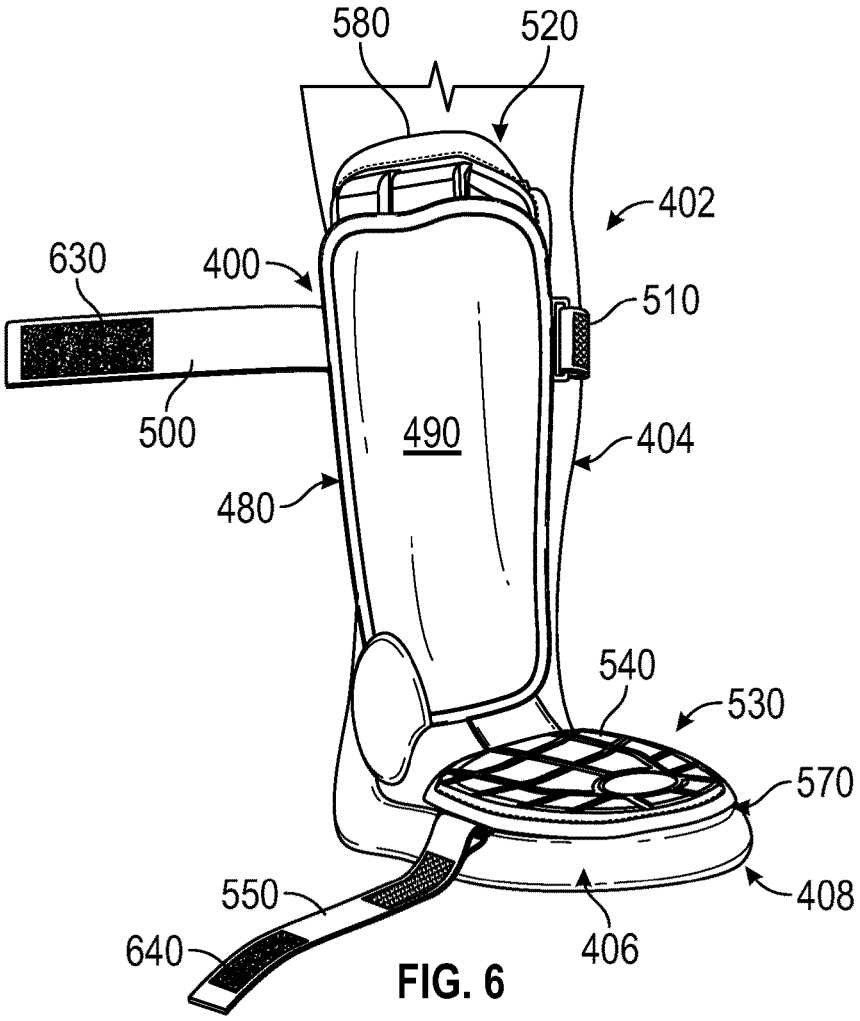
FIG. 6 is a perspective view of an embodiment of a combination sliding mitten and lower-leg protector in a lower-leg protector configuration.
Figure 7:
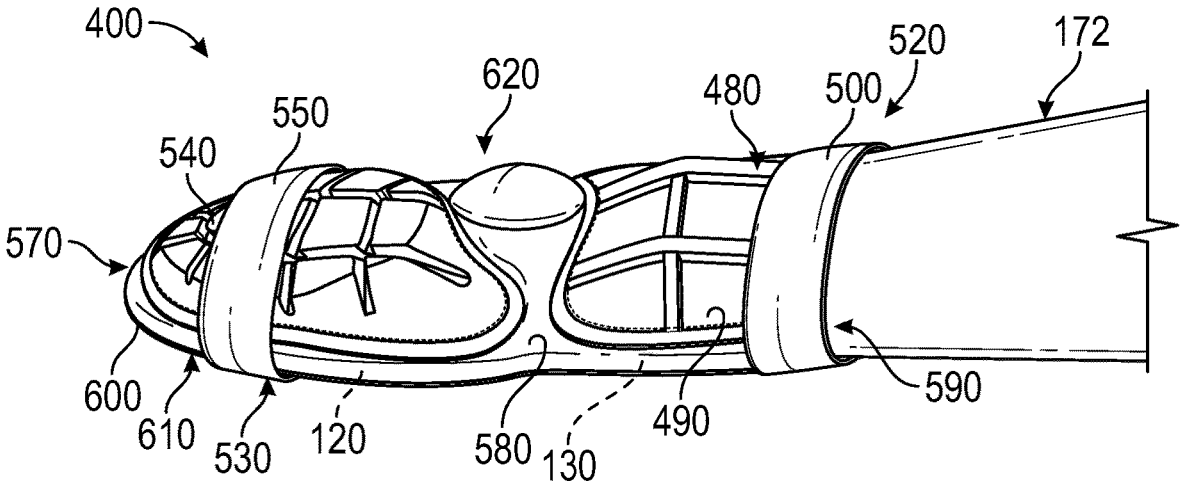
FIG. 7 is a perspective view of the combination sliding mitten and lower-leg protector in a sliding mitten configuration.

With reference to FIGS. 6 and 7, an embodiment of a combination sliding mitten and lower-leg protector 400 and method of using the same will be described.

The combination sliding mitten and lower-leg protector ("protector") 400 quickly and easily converts between sliding mitten configuration (FIG. 7) applied to a user's hand 120 and wrist area 130, protecting the user's hand 120 and wrist area 130 when sliding into base, and a lower-leg protector configuration (FIG. 6) applied to a user's lower leg 402 (shin 404, upper portion ("upper foot portion") 406 of foot 408), protecting the user's lower leg 402, and especially the shin 404 and upper foot portion 406, when batting.

The protector 400 includes an upper leg member 480 including an upper leg guard 490, one or more upper/first straps 500, 510, and a distal end 520, a lower leg member 530 including a lower guard 540, one or more lower/second straps 550, and a distal end 570, and a sliding mitten sleeve 580 extending from the distal end 520 of the upper leg member 580 to the opposite distal end 570 of the lower leg member 530. The sliding mitten sleeve 580 includes an open end 590 at the distal end 520 of the upper leg member 580, a closed end 600 at the distal end 570 of the lower leg member 530, a front 610 with a sliding pad 312 (FIGS. 2, 3) and a rear 620. In alternative embodiments, the protector 400 includes one or more (e.g., 1, 3, etc.) leg guards.

The one or more upper/first straps 500, 510 and the one or more lower/second straps 550 include hook and loop fastener sections 630, 640.

The sliding mitten sleeve 580 includes a sliding wrist support 350 (FIGS. 2, 3).

In the lower-leg protector configuration (e.g., when a user is up to bat) of FIG. 6, the user's lower leg 402, and especially the shin 404 and upper foot portion 406, is received along the sliding mitten sleeve 580 and protected by the one or more lower-leg guards 490, 540. In this configuration, the player's lower leg 402 is received along the sliding mitten sleeve 580, strapped by the one or more upper/first straps 500, 510 to and protected by the upper guard 490, and the player's upper foot portion 406 is received along the sliding mitten sleeve 580, strapped by the one or more lower/second straps 550 to and protected by the lower guard 540.

In the sliding mitten configuration (e.g., when on base) of FIG. 7, the player's hand 120 is received within the sliding mitten sleeve 580 and protected by the one or more guards 490, 540. In this configuration, the player's hand 120 is received within the sliding mitten sleeve 580, strapped by the one or more lower/second straps 550 to and protected by the lower guard 540, and the player's wrist area 130 is received within the sliding mitten sleeve 580, strapped by the one or more upper/first straps 550 to and protected by the upper guard 490. In this configuration, the player's wrist area 130 is supported by the sliding wrist support 650 and the sliding pad 312 (FIGS. 2, 3) and guard(s) 490, 540 provide double-layer protection, which also reduces shock to the player's hand 120 when sliding into base.

A method of using the combination sliding mitten and elbow protector 400 as baseball/software gear to protect the user's lower leg 402 when batting and to protect the user's hand 120 when sliding to the base comprises, at bat, donning the combination sliding mitten and lower-leg protector 400 in the lower-leg protector configuration of FIG. 6 so that the player's lower leg 402 is received along the sliding mitten sleeve 580 and protected by the one or more guards 490, 540. Donning in the lower-leg protector configuration further comprises, donning the combination sliding mitten and lower-leg protector 400 in the lower-leg protector configuration so that the player's shin 404 is received along the sliding mitten sleeve 580, strapped to and protected by the upper guard 490 by the one or more upper/first straps 500, 510, and the player's upper foot portion 406 is received along the sliding mitten sleeve 580, strapped to and protected by the lower guard 540 by the one or more lower/second straps 550. The method further comprises, on base, donning the combination sliding mitten and lower-leg protector 400 in the sliding mitten configuration so that the hand 120 of the player's arm 172 is received within the sliding mitten sleeve 580 and protected by the one or more guards 490, 540 during sliding. Donning in the sliding mitten configuration further comprises, donning the combination sliding mitten and lower-leg protector 400 in the sliding mitten configuration so that player's hand 120 is received within the sliding mitten sleeve 580, strapped to and protected by the lower guard 540 by the one or more lower/second straps 550, and the player's wrist 130 is received within the sliding mitten sleeve 580, strapped to and protected by the upper guard 490. Donning in the sliding mitten configuration still further comprises supporting the player's wrist 130 by the sliding wrist support 350.

Advantages of the protector 100, 400 include double layer protection, reducing shock, and reduced time during the game.

The figures may depict exemplary configurations for the invention, which is done to aid in understanding the features and functionality that can be included in the invention. The invention is not restricted to the illustrated architectures or configurations, but can be implemented using a variety of alternative architectures and configurations. Additionally, although the invention is described above in terms of various exemplary embodiments and implementations, it should be understood that the various features and functionality described in one or more of the individual embodiments with which they are described, but instead can be applied, alone or in some combination, to one or more of the other embodiments of the invention, whether or not such embodiments are described and whether or not such features are presented as being a part of a described embodiment. Thus the breadth and scope of the present invention, especially in the following claims, should not be limited by any of the above-described exemplary embodiments.

Terms and phrases used in this document, and variations thereof, unless otherwise expressly stated, should be construed as open ended as opposed to limiting. As examples of the foregoing: the term "including" should be read as mean "including, without limitation" or the like; the term "example" is used to provide exemplary instances of the item in discussion, not an exhaustive or limiting list thereof; and adjectives such as "conventional," "traditional," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although item, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

I claim:

1. A combination sliding mitten and lower-leg protector, comprising:

a sliding mitten sleeve;

one or more lower-leg guards carried by the sliding mitten sleeve, wherein:

in a lower-leg protector configuration, a user's lower leg is received along the sliding mitten sleeve and protected by the one or more lower-leg guards, in a sliding mitten configuration, a user's hand is received within the sliding mitten sleeve and protected by the one or more lower-leg guards, wherein the one or more lower-leg guards include an upper guard with one or more upper guard straps and a lower guard including one or more lower guard straps, the sliding mitten sleeve includes an open end and an opposite closed, wherein:

in the lower-leg protector configuration, the user's lower leg is received along the sliding mitten sleeve, strapped to and protected by the upper guard by the one or more upper guard straps, and the user's upper foot portion is received along the sliding mitten sleeve, strapped to and protected by the lower guard by the one or more lower guard straps, in a sliding mitten configuration, a user's hand is received within the sliding mitten sleeve, strapped to and protected by the lower guard by the one or more lower guard straps, and the user's wrist is received within the sliding mitten sleeve, strapped to and protected by the upper guard by the one or more upper guard straps.

2. The combination sliding mitten and lower-leg protector of claim 1, further including a sliding wrist support, and, in the sliding mitten configuration, the user's wrist is supported by the sliding wrist support.

3. A method of using a combination sliding mitten and lower-leg protector, the combination sliding mitten and lower-leg protector comprising a sliding mitten sleeve; one or more lower-leg guards carried by the sliding mitten sleeve, wherein, in a lower-leg protector configuration, a user's lower leg is received along the sliding mitten sleeve and protected by the one or more lower-leg guards, in a sliding mitten configuration, a user's hand is received within the sliding mitten sleeve and protected by the one or more lower-leg guards, comprising:

at bat, donning the combination sliding mitten and lower-leg protector in the lower-leg protector configuration so that the player's lower leg is received along the sliding mitten sleeve and protected by the one or more lower-leg guards;

on base, donning the combination sliding mitten and lower-leg protector in the sliding mitten configuration so that player's hand is received within the sliding mitten sleeve and protected by the one or more lower-leg guards.

4. A method of using the combination sliding mitten and lower-leg protector of claim 1, comprising:

at bat, donning the combination sliding mitten and lower-leg protector in the lower-leg protector configuration so that the player's lower leg is received along the sliding mitten sleeve, strapped to and protected by the upper guard by the one or more upper guard straps, and the player's lower arm is received along the sliding mitten sleeve, strapped to and protected by the lower guard by the one or more lower guard straps;

on base, donning the combination sliding mitten and lower-leg protector in the sliding mitten configuration so that player's hand is received within the sliding mitten sleeve, strapped to and protected by the lower guard by the one or more lower guard straps, and the player's wrist is received within the sliding mitten sleeve, strapped to and protected by the upper guard.

5. The method of using the combination sliding mitten and lower-leg protector of claim 4, further including a sliding wrist support, and, in the sliding mitten configuration, the player's wrist is supported by the sliding wrist support.

* * * * *